US007642969B2

(12) United States Patent
Nam

(10) Patent No.: US 7,642,969 B2
(45) Date of Patent: Jan. 5, 2010

(54) MOBILE COMMUNICATION TERMINAL INCORPORATING INTERNAL ANTENNA

(75) Inventor: Soo Hyun Nam, Gyeonggi-do (KR)

(73) Assignee: LG Electronics Inc., Seoul (KR)

( * ) Notice: Subject to any disclaimer, the term of this patent is extended or adjusted under 35 U.S.C. 154(b) by 88 days.

(21) Appl. No.: 11/695,543

(22) Filed: Apr. 2, 2007

(65) Prior Publication Data

US 2007/0236398 A1 Oct. 11, 2007

(30) Foreign Application Priority Data

Apr. 6, 2006 (KR) ..... 10-2006-0031383
Nov. 23, 2006 (KR) ..... 10-2006-0116279

(51) Int. Cl.
*H01Q 1/24* (2006.01)

(52) U.S. Cl. ..... 343/702; 343/700 MS; 343/895

(58) Field of Classification Search ..... 343/700 MS, 343/702, 895
See application file for complete search history.

(56) References Cited

U.S. PATENT DOCUMENTS 6,166,694 A * 12/2000 Ying ..... 343/702
6,337,663 B1 * 1/2002 Chi-Ming ..... 343/702
7,245,260 B2 * 7/2007 Chang ..... 343/700 MS
7,319,432 B2 * 1/2008 Andersson ..... 343/702

FOREIGN PATENT DOCUMENTS

| | | |
|---|---|---|
| JP | 09-162633 | 6/1997 |
| JP | 11-243318 | 9/1999 |
| KR | 20-0289515 Y1 | 9/2002 |
| KR | 20-0289575 | 9/2002 |
| KR | 10-2003-0053054 A | 6/2003 |
| KR | 10-2005-0001488 A | 1/2005 |
| KR | 10-2005-0082150 A | 8/2005 |
| KR | 10-2006-0057106 | 5/2006 |
| WO | 99/63618 | 12/1999 |

* cited by examiner

*Primary Examiner*—Hoang V Nguyen
(74) *Attorney, Agent, or Firm*—Lee, Hong, Degerman, Kang & Waimey

(57) ABSTRACT

A mobile communication terminal and an internal multi-band antenna are described. The internal antenna is formed on a substrate and has a first pattern and a second pattern. Both patterns may be formed on one side of the substrate, or one pattern may be formed on each side of the substrate. The first pattern and the second pattern have different widths. The terminal may be of any type such as a folding type terminal, a slider-type terminal, or a bar type terminal.

32 Claims, 14 Drawing Sheets

(a)

(b)

(a)

(b)

| TRP TIS | folder state | GSM850 | | | | PCS | | | | | |
|---|---|---|---|---|---|---|---|---|---|---|---|
| | | 128 | | 251 | | 512 | | 699 | | 885 | |
| | | TIS | TRP | TIS | TRP | TIS | TRP | TIS | TRP | TIS | TRP |
| Related art | | 99.8 | | 100.5 | | | | | | | |
| | | 105.46 | 28.47 | 105.85 | 29.50 | | | 97.51 | | | |
| Embodiment | CL | 100.90 | | 102.00 | | | | | | | |
| | OP | 105.67 | 28.40 | 106.37 | 29.60 | 98.50 | 26.60 | 98.30 | 26.40 | 99.75 | 26.25 |

FIG. 19

MOBILE COMMUNICATION TERMINAL INCORPORATING INTERNAL ANTENNA

CROSS-REFERENCE TO RELATED APPLICATIONS

This non-provisional application claims priority under 35 U.S.C. § 119(a) to Patent Application Nos. 10-2006-0031383 and 10-2006-0116279 filed in Korea on Apr. 6, 2006 and on Nov. 23, 2006 respectively, the entire contents of which are hereby incorporated by reference.

FIELD OF THE INVENTION

The present invention relates to an internal antenna and a mobile communication terminal using the internal antenna.

DESCRIPTION OF THE RELATED ART

In general, an antenna is an electronic component designed to receive and transmit radio signals. The antenna is an essential component in a mobile communication terminal; the antenna enables signal transmission and reception between a terminal and a base station.

Most mobile communication terminals have external antennas that are easily damaged and may physically interfere with other objects. Such problems have encouraged the development of an internal antenna. However, internal antennas have a narrow bandwidth and are not suitable for the current technology of mobile broadband communication terminals to provide the diverse functions of today's communication services.

Most of the conventional internal antennas require a volumetric space of more than 40 cc. In many instances, the available volumetric space may be as small as about 0.8 cc due to an increase in the number of component parts required by a mobile communication terminal to accommodate more bands.

To overcome this problem, an antenna formed on a printed circuit board (PCB) has been developed. The PCB-type antenna does not achieve a desired level of efficiency because of the antenna pattern. Other causes of the poor efficiency are the influence radio frequency interference of a camera in the surrounding area and a flexible PCB electrically connecting the camera with the other internal components of the mobile communication terminal. Also, when a folder-type mobile communication terminal is closed, the electrical characteristics of the antenna further deteriorate decreasing the antenna's efficiency.

SUMMARY

Accordingly, the present invention is to solve at least the problems and disadvantages of the background art. A mobile communication terminal for use in a multi-frequency band wireless communication includes a case configured to house a circuit board and an antenna module disposed inside the case for transmitting and receiving on a first and a second frequency band. The antenna includes: a substrate; a first pattern formed on the substrate for the first frequency band having a first length and a first width; and a second antenna pattern formed on the substrate for the second frequency band having a second length and a second width that is different from the first width wherein the second antenna pattern is connected to the first antenna pattern.

The antenna may be formed with the first pattern on one side of the substrate and the second pattern on the other side of the substrate, and the patterns may be connect using a via hole. Alternately, the antenna may be formed with the first and the second pattern on one side of the substrate. In either case, the first pattern is electrically connected to the second pattern.

The substrate may be connected to the terminal using surface mount technology. The second antenna pattern may be either a spiral shape or a meander shape; one end of the second antenna pattern serves as a collection surface and may be formed in any convenient shape such as a polygon.

The first antenna pattern is formed to have a half wavelength of the first frequency band that makes a secondary resonance

BRIEF DESCRIPTION OF THE DRAWINGS

The invention will be described in detail with reference to the following drawings in which like numerals refer to like elements.

FIG. 19 shows TRP and Total Isotropic Sensitivity (TIS) results of the mobile communication terminal having the antenna in accordance with the present invention.

DETAILED DESCRIPTION OF PREFERRED EMBODIMENTS

The invention will be described in a more detailed manner with reference to the drawings.

Objects of the invention include: to provide an antenna and a mobile communication terminal comprising the antenna; to maximize the characteristics of the antenna at the high and low frequency bands; to miniaturize the antenna; to support and shield the antenna from being influenced by other component parts and losing its radiation characteristics; and to mount the antenna in the inside of a mobile communication terminal and make the mobile communication terminal slim, easily used by a user;

Other objects of the invention include: to provide an antenna and a mobile communication terminal having improved signal reception performance when a folder-type mobile communication terminal is closed; and to provide an antenna and a mobile communication terminal with improved signal reception performance when a folder-type mobile communication terminal is closed.

Figure 1:
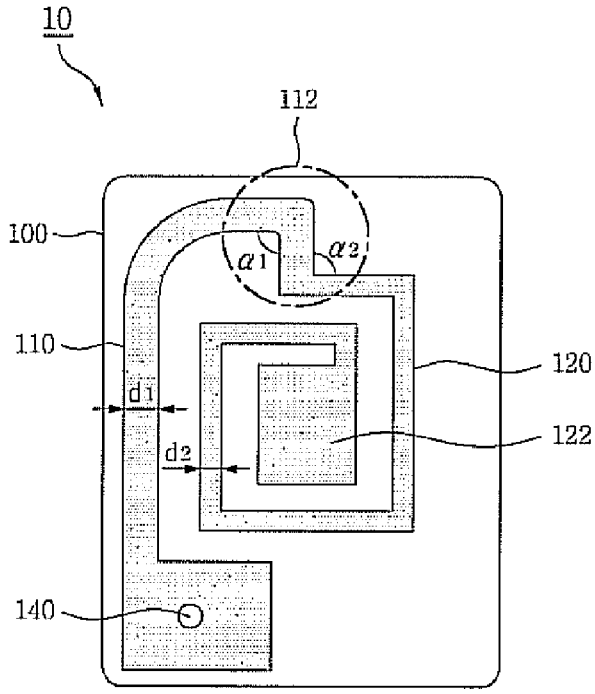
FIG. 1 is a front view of an antenna according to one aspect of the invention wherein the highband and the lowband antennas are formed on one side of a PCB.
Figure 2:
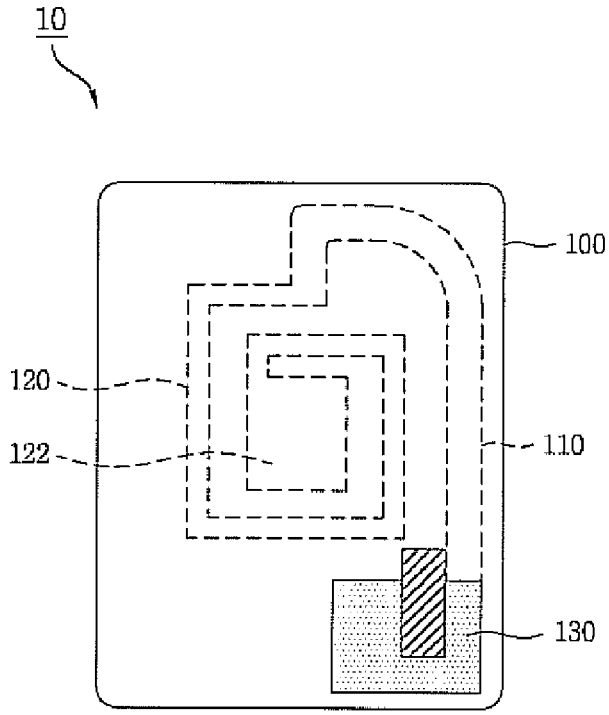
FIG. 2 is a rear view of the antenna shown in FIG. 1.

FIG. 1 is a front view and FIG. 2 is a rear view of an antenna according to one aspect of the present. As shown in FIGS. 1 and 2, the antenna comprises a substrate 100, a first pattern 110, a second pattern 120, a bushing 130, and a feed point 140.

The first pattern 110 and the second pattern 120 of the antenna 10 are formed on the substrate 100. The first pattern 110 is formed on one side of the substrate 100 wherein a portion of the first pattern 110 is formed as a straight line. The length of the first pattern 110 may be the same length as a half wavelength of a secondary resonance frequency.

The second pattern is connected to one end of the first pattern 110, and the second pattern 110 has a width different from the width of the first pattern 100. One end 112 of the first pattern 110 is connected to the second pattern 120 at a predetermined angle.

The bushing 130, FIG. 2, feeds power to the antenna 10. The bushing 130 may utilize Surface Mount Technology (SMT) on the rear side of the substrate 100.

The feed point 140 connects the antenna 10 to a feed circuit (not shown), and is formed as a hole at a position corresponding to the bushing 130 at one end of the first pattern 110.

The antenna described above will now be described in greater detail as follows. The first pattern 110 is formed on one side of the substrate 100 and part of the first pattern 110 is formed in a straight line. One end of the first pattern 110 is connected to the second pattern 120. The end 112 of the first pattern 110 is connected to the second pattern 120 forming a predetermined angle $\alpha_1$ with respect to the other end of the first pattern 110 and forms another predetermined angle $\alpha_2$ with respect to the other end of the second pattern 120.

For example, the end 112 of the first pattern 110 connected to the second pattern 120 forms an angle of about 90° ($\alpha_1$=90°) with respect to the other end of the first pattern 110 and forms an angle of about 90° ($\alpha_2$=90°) with respect to one end of the second pattern 120. The end 112 of the first pattern is electrically connected to the second pattern 120.

The interference between the first pattern 110 and the second pattern 120 can be reduced effectively by entirely forming the first pattern 110 outward of the second pattern 120 as shown in FIG. 1.

The first and second patterns 110 and 120 of the antenna 10 are formed on a printed circuit board (PCB), and the entire length of the first and second patterns 110 and 120 has low frequency band characteristics. The first pattern 110 has high frequency band characteristics.

Primary resonance at low frequency bands occurs in the entire length of the first and second patterns 110 and 120, and secondary resonance at high frequency bands occurs in the first pattern 110. Resonance means a frequency selection characteristic for a predetermined frequency, and a frequency selection characteristic quality factor (Q) which signifies how well frequency can be selected.

However, when patterns are connected into one pattern having both high and low frequency band characteristics, the frequency selection characteristic quality factor (Q) of the high frequency band may be decreased compared to that of the low frequency bands. Thus, a parasitic resonance point is generated in a low frequency part of the high frequency bands, and this may cause the high frequency band characteristics to deteriorate.

To prevent the high frequency band characteristics from deteriorating, the first pattern 110 is disposed toward the edge of the substrate 100, and the first pattern 110 has a width of $d_1$.

However, when the entire pattern of the antenna 10 is formed having the width of $d_1$ of the first pattern 110, and the distance between the patterns are maintained uniformly, the size of the entire antenna 10 becomes large and reduces the value as an internal antenna.

Therefore, the pattern of the high frequency portion 110 is formed having a width $d_1$ until the length of the pattern 110 equals a half wavelength of a frequency of the secondary resonance, and then the pattern of the second portion of the antenna 120 is formed having a relatively narrower width $d_2$. Consequently, the width $d_1$ of the first pattern 110 is formed wider than the width $d_2$ of the second pattern 120.

Also, the second pattern 120 is preferably formed in a spiral structure to minimize the size of the antenna 10. The collection surface 122 of the second pattern 120 is formed in a square shape having a predetermined surface to collect electric current in the square shape to improve open characteristics of the antenna 10.

The open characteristics of the antenna 10 mean that, when a pattern of an antenna is open, signals finding no place to go are totally reflected and returned. Accordingly, the square shape is formed having a predetermined surface at the collection surface 122 of the second pattern 120. The open characteristics can be improved by collecting electric currents in the square shape.

The bushing 130 for feeding the antenna 10 is formed at the back surface of substrate 100 where the first and second patterns 110 and 120 are formed. The bushing 130 is formed using surface mount technology to reduce production costs and performance variations between products.

A feed point 140 is formed in the form of a via hole in one end of the first pattern 110 at a position corresponding to the bushing 130.

Figure 3:
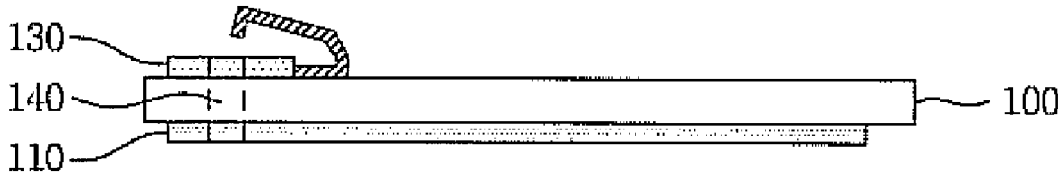
FIG. 3 is a side view of the antenna of FIG. 1 showing a feed point.

FIG. 3 is a side view showing a feed point formed in the form of a via hole in accordance with the present invention. As shown in the drawing, the feed point 140 connects the antenna 10 with a feed circuit, and is in the form of a via hole in one end of the first pattern 110 at a position corresponding to the bushing 130.

The feed point 140 makes it possible to feed the antenna 10 from the rear side of the substrate 100. Since the antenna 10 can be formed with a through connection to the front side, the antenna can be designed without any restriction on the locations of the first and second patterns 110 and 120.

The above description describes the second pattern 120 having a spiral structure. However, the present invention should not be limited and another example of a different shape for the second pattern 120 is presented in FIG. 4.

Figure 4:
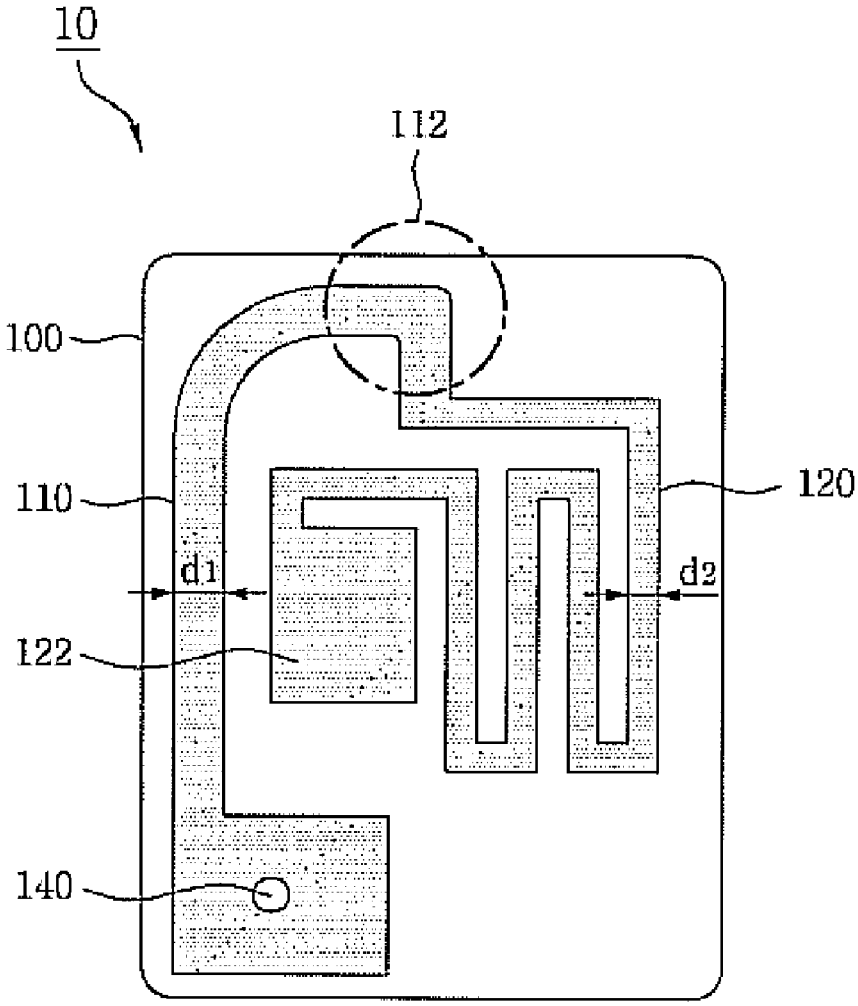
FIG. 4 is a front view of an antenna wherein the second pattern is different than the antenna of FIG. 1.

As shown in FIG. 4, the second pattern 120 connected to one end of the first pattern 110 may be formed in a meander structure. The meander structure of the second pattern 120 can also increase a spatial efficiency of the antenna 10, just as the spiral structure does. In this example, the width $d_1$ of the first pattern 110 is different from the width $d_2$ of the second pattern 120, and a collection surface 122 of the second pattern 120 is formed in a square shape having a predetermined surface.

Figure 5:
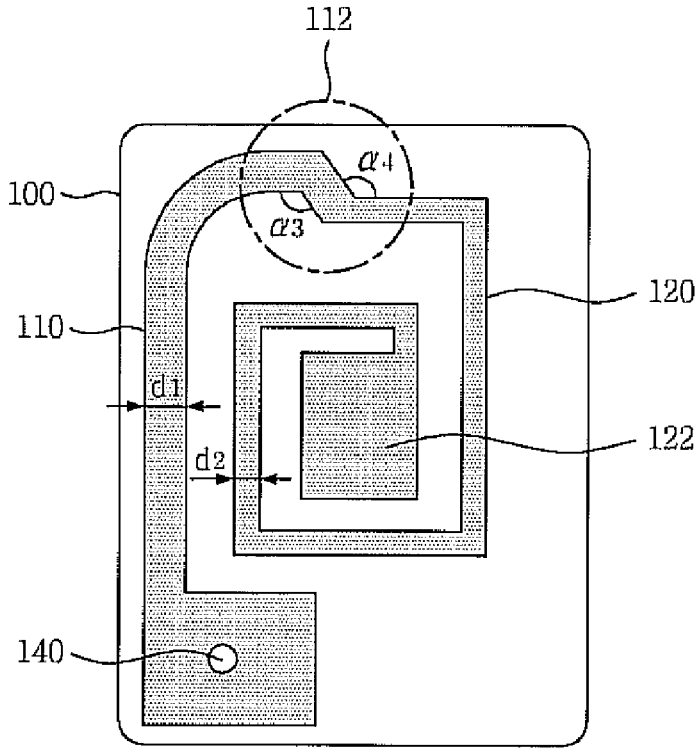
FIG. 5 is a front view of the antenna of FIG. 1 wherein the end of the first pattern connects to the second pattern at a predetermined angle.

FIG. 5 is a front view of an antenna illustrating another example of the antenna. The second pattern 120 is connected to an end of the first pattern 110 and is formed in a spiral structure. An end 112 of the first pattern 110 connected to the second pattern 120 forms a predetermined angle $\alpha_3$ with respect to the other end of the first pattern 110, and it forms another predetermined angle $\alpha_4$ with respect to the second pattern 120. Angles $\alpha_3$ and $\alpha_4$ are not 90° as in the previous example. As described above, the angular end 112 of the first pattern 110 electrically connects to the second pattern 120.

The other details of this example are similar as those of the previous examples. For example, the width $d_1$ of the first pattern is different from the width $d_2$ of the second pattern 120, and a collection surface 122 of the second pattern 120 is formed in a square shape having a predetermined surface.

Figure 6:
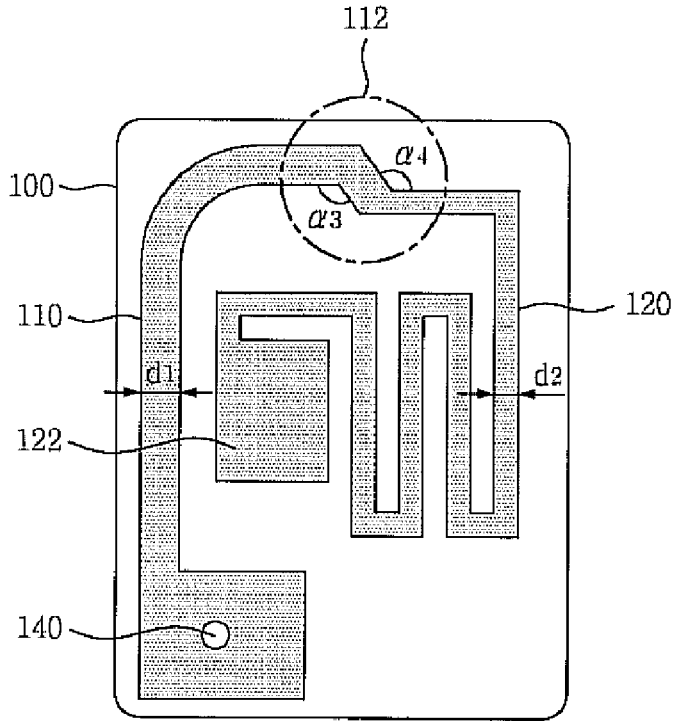
FIG. 6 is a front view of the antenna of FIG. 4 wherein the end of the first pattern connects to the second pattern at a predetermined angle.

FIG. 6 is a front view of another example of the antenna described above. As shown in FIG. 6, the second pattern 120 connected to an end of the first pattern 110 is formed in a meander structure. Just as described with reference to FIG. 5, the end 112 of the first pattern 110 connected to the second pattern 120 forms a predetermined angle $\alpha_3$ with respect to the other end of the first pattern 110 and forms another predetermined angle $\alpha_4$ with respect to an end of the second pattern 120.

Although the above-described examples only describe a square-shaped collection surface 122 of the second pattern 120, the embodiments are not restrictive but descriptive. Other examples are presented below.

Figure 7A:
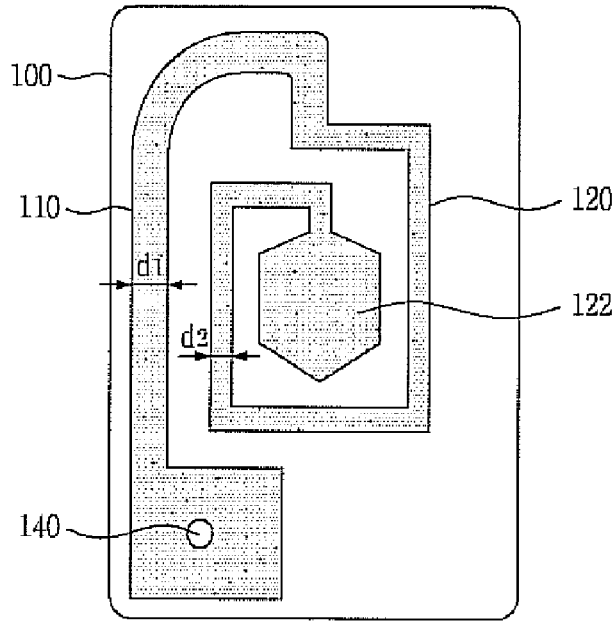
FIGS. 7A and 7B is a front view of the antenna of FIG. 1 wherein the end of the second pattern has different shapes.
Figure 7B:
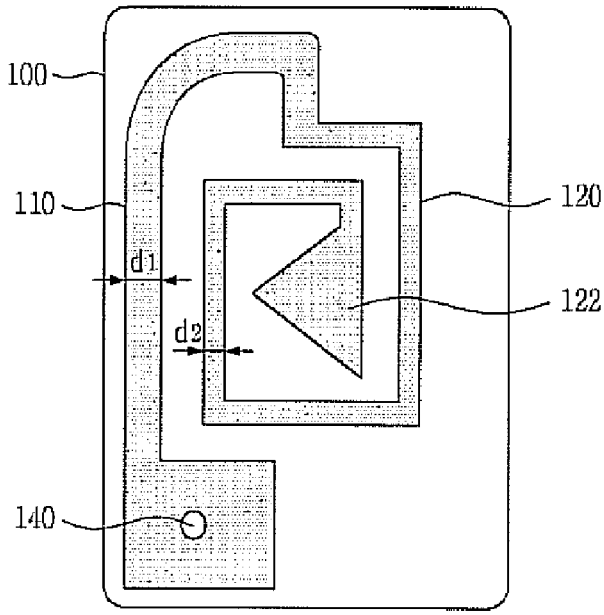

FIGS. 7A and 7B are exemplary front views showing the shape of an end of a second pattern. A collection surface 122 of the second pattern may be formed in a pentagonal shape, as shown in FIG. 7A, or it may be formed in a triangular shape, as shown in FIG. 7B. In short, the collection surface 122 of the second pattern 120 may be formed in any shape as long as it has a predetermined surface.

Figure 8:
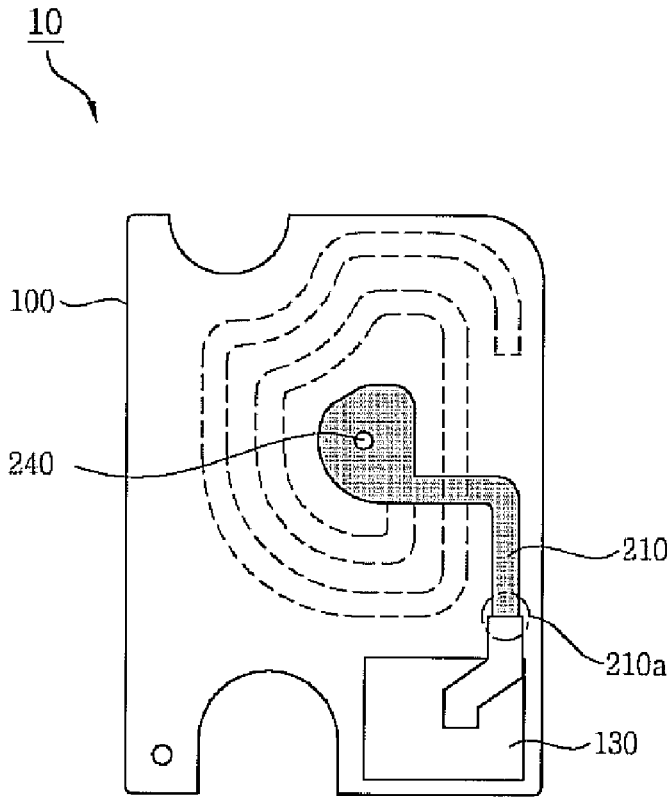
FIG. 8 is a rear view of an antenna according to another aspect of the invention wherein the highband antenna is formed on one side of the PCB and the lowband antenna is formed on the other side of the PCB.
Figure 9:
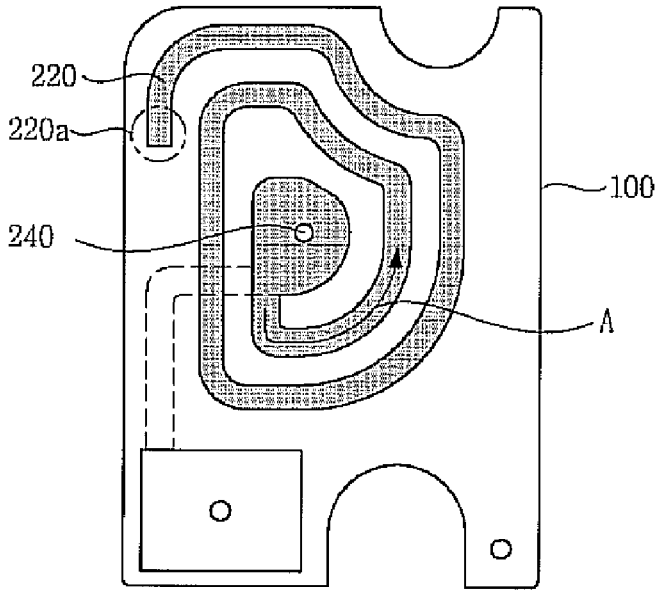
FIG. 9 is a front view of the antenna of FIG. 8 showing the lowband antenna formed on the PCB.

FIG. 8 and FIG. 9 show a rear view and a front view respectively of an antenna having patterns on different sides in accordance with another aspect of the present invention.

The bushing 130 formed on the substrate 100 is connected to a feed point of the antenna 10. The bushing 130, however, is formed on the rear side of the substrate 100 and connected to the first pattern 210. The bushing 130 is formed to be available for SMT.

The first pattern 210 is formed on the rear side of the substrate 100. A part of the first pattern 210 connected to the bushing 130 is formed upward along the side of the substrate 100 in a straight line. Also, another part of the first pattern 210 is formed from the center of the side of the substrate 100 to a position corresponding to the center of the substrate 100. The second pattern 220 is formed on the front side of the substrate 100, and it is connected to the first pattern 210 through a via hole 240.

The antenna according to this aspect of the invention will now be described in greater detail as follows. First, the bushing 130 is formed on the rear side of the substrate 100. The bushing 130 is disposed on one side of the rear side of the substrate 100, connected to a feed point of the antenna 10, and supplies power to the first pattern 210. The bushing 130 is formed to be available for Surface Mount Technology thereby reducing manufacturing costs and minimizing variations of quality among products.

A part of the first pattern 210 is formed along the edge of the substrate 100 in a straight line to the center of one side of the substrate 100. Another part of the first pattern 210 is formed from the center of the side of the substrate 100 to a position corresponding to the center of the substrate 100. Since the pattern of the antenna 10 is long, the initial radiation can be increased. Also, a part of the first pattern 210 is formed horizontally at a position corresponding to the center of the substrate 100, and this portion of pattern 210 functions as a horizontal ground.

A second pattern 220 is formed on the front side of the substrate 100. The first pattern 210 and the second pattern 220 are connected through the via hole 240. The second pattern 220 is formed in a spiral structure having a predetermined angle (A) from the central part of the substrate 100 connected to the first pattern 210.

When the first pattern 210 and the second pattern 220 are formed having a spiral structure, a parasitic resonance occurs to narrow the bands. However, when the first pattern 210 and the second patterns 220 are formed on different sides and connected to each other, the patterns of the antenna are longer thereby resolving the band-narrowing problem.

The first pattern 210 and the second pattern 220 are formed on a PCB and have both low and high frequency band characteristics. Therefore, a primary resonance, which is resonance in the low frequency bands, is generated from the entire length of the first pattern 210 and the second pattern 220, and a secondary resonance, which is resonance in the high frequency bands, is generated from a half wavelength of a secondary resonate frequency between the first pattern 210 and the second pattern 220.

However, when patterns are connected and have both high and low frequency band characteristics, the high frequency band characteristics may have a lower frequency selection quality (Q) than the low frequency band characteristics. Thus, a parasitic resonance point may be generated in the lower part of the high frequency bands, and this may deteriorate the high frequency band characteristics.

The first pattern 210 and the second pattern 220 are formed on different sides of the substrate 100. Since the patterns are long and the first pattern 210 rarely overlaps the second pattern 220, the generation of parasitic resonance points can be minimized. Thus, deterioration of the high frequency band characteristics are minimized.

Also, a terminal end 220*a* of the second pattern 220 is formed at the edge of the substrate 100. Since the terminal end 220*a* is formed at the edge of the substrate 100, an electric field is formed. Also, since the terminal end 220*a* is formed at the edge, the length of the patterns can be easily adjusted in the antenna 10. Thus, a frequency can be easily tuned.

As described above, when an initial end 210*a* of the first pattern 210 is formed upward along the edge of the substrate 100, it is possible easily to form a ground (GND) and an electromagnetic field.

Since part of the first pattern 210 is horizontally formed at a position corresponding to the center of the substrate 100, it can function as a horizontal ground. On the other hand, the second pattern 220 may function as a vertical ground by placing the terminal end 220*a* at the edge the substrate 100 in the uppermost part of the antenna 10 and forming part of the second pattern 220 in a straight line.

Figure 10:
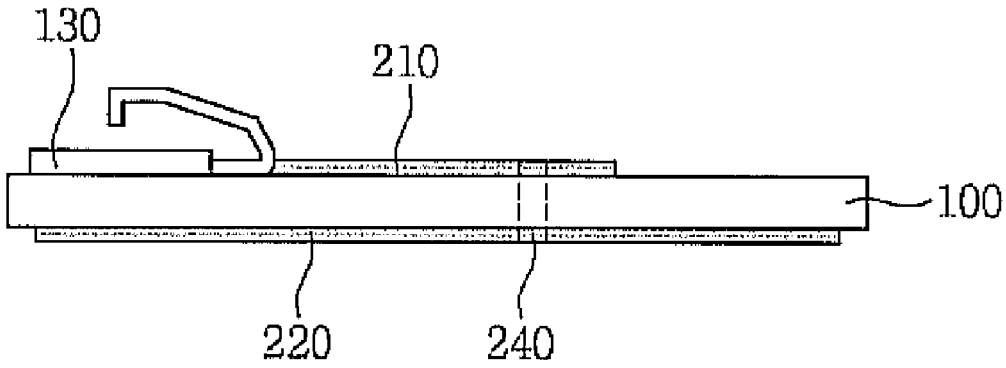
FIG. 10 is a side view of the antenna shown in FIGS. 8 and 9.

The structure of the antenna 10 will be described in detail with reference to FIG. 10. The bushing 230 and the first pattern 210 are formed on the rear side of the substrate 100, while the second pattern 220 is formed on the front side of the substrate 100. The first pattern 210 and the second pattern 220 are connected through the via hole 240. The first pattern 210 is connected to the bushing 130 which may use Surface Mount Technology, and it is fed by receiving electrical signals from the bushing 130.

Although the second pattern 220 having a spiral structure has been described in the above aspect, the present invention is not limited to the spiral-structured pattern. Another example is presented below.

Figure 11:
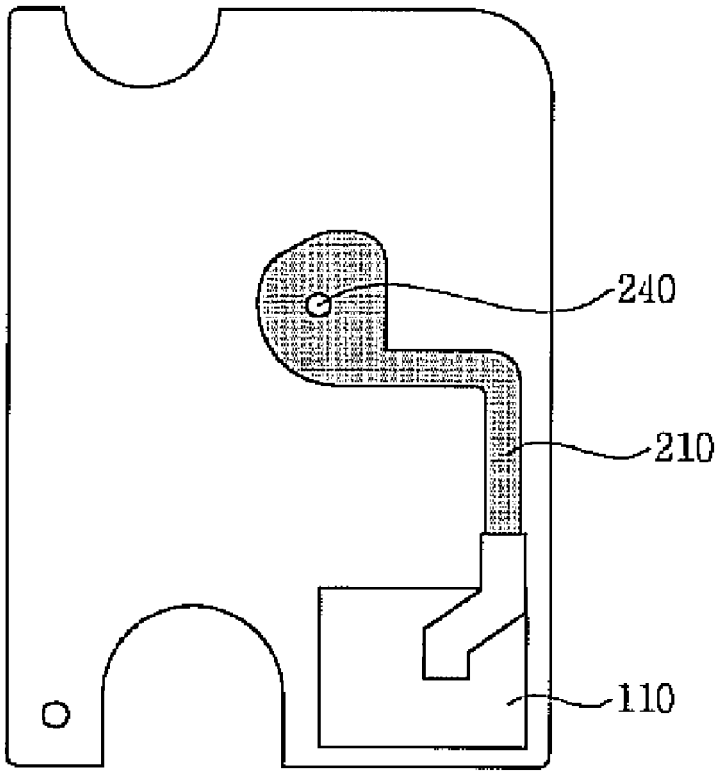
FIG. 11 is a rear view of the antenna shown in FIG. 8.
Figure 12:
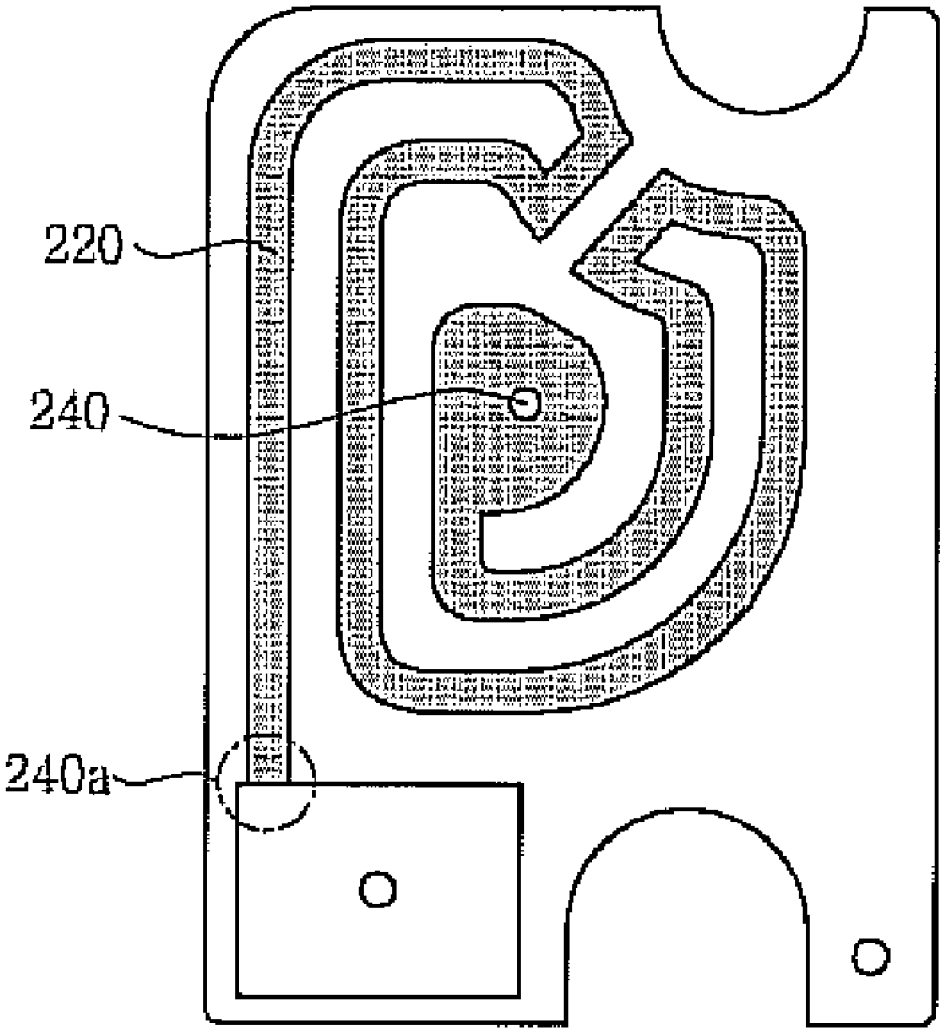
FIG. 12 is an alternate pattern of the lowband antenna shown in FIG. 9.

FIG. 11 and FIG. 12 are a rear view and a front view respectively of another example the antenna in accordance with the present invention. The antenna 10 suggested in this example comprises the substrate 100, a bushing 130, the first pattern 210, and the second pattern 220. Since the constituent elements and the specific operation of the antenna 10 are the same as described in the above, further description is omitted for brevity.

The first pattern 210 and the second pattern 220 are disposed on different sides of the substrate 100 in the antenna 10, which is the same as in the previous example, and they are connected to each other through the via hole 240.

The second pattern 220 is formed to have a structure that is not spiraled in one direction, which is different from the second pattern 220 of the previous example. This structure minimizes the generation of parasitic resonance and resolves the band-narrowing problem.

Moreover, part of the second pattern 220 is formed to extend to the edge of substrate 100. Since the pattern becomes longer than that of the previous example in the antenna 10, the effect of resolving the band-narrowing problem is improved over the previous example.

As described above, both initial end 210*a* of the first pattern 210 and the terminal end 220*a* of the second pattern 220, which are the points of the strongest electromagnetic field of the antenna patterns, are disposed at the edge of the substrate 100. Since a portion of the antenna where the electromagnetic field is weak is disposed in the inner part of the substrate 100, the resonance characteristic is not deteriorated.

The antenna 10 described in the above can be mounted on the mobile communication terminal as follows.

Figure 13:
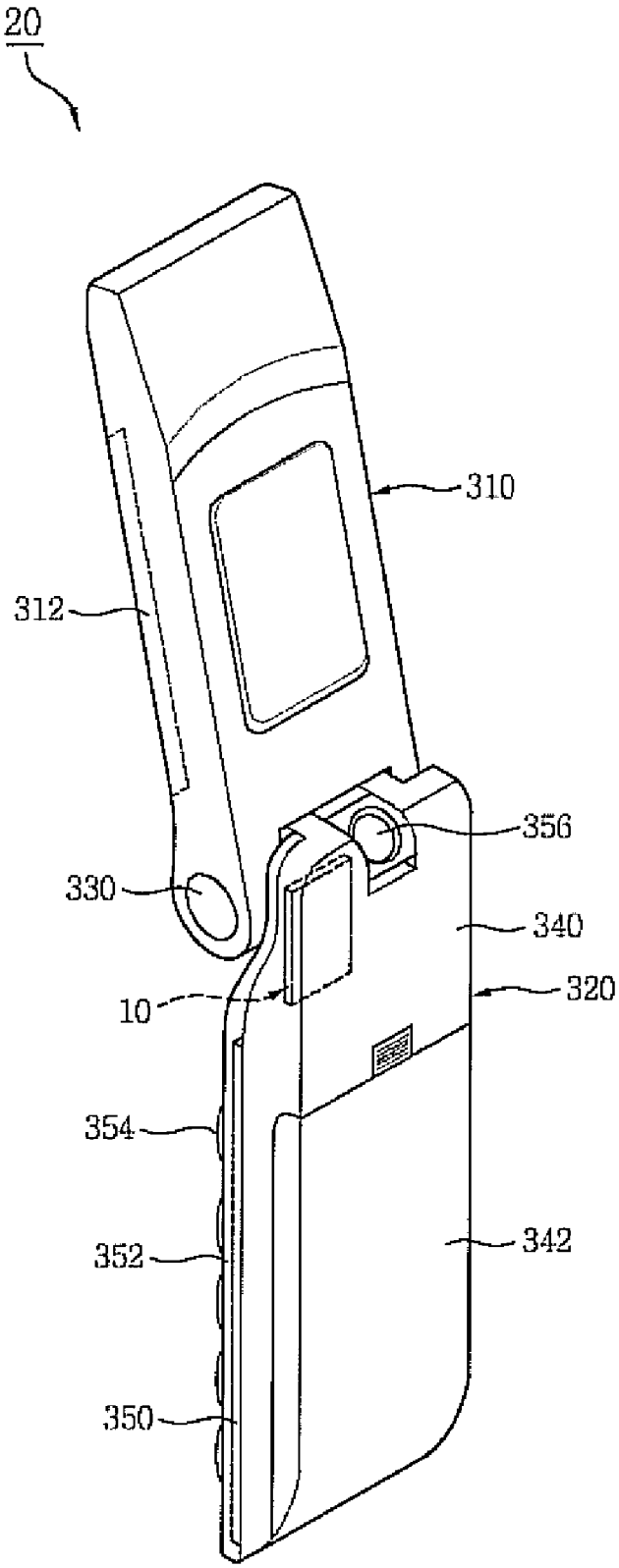
FIG. 13 is a perspective view of a mobile communication terminal showing one placement of an internal antenna.

FIG. 13 is a perspective view showing a mobile communication terminal comprising an antenna in accordance with one aspect of the present invention. The mobile communication terminal 20 comprises an upper folder part 310 and a lower folder part 320. The upper and lower folder parts 310 and 320 are combined with each other with a hinge part 330 capable of rotating the upper and lower folder parts 310 and 320.

The upper folder part 310 comprises a display unit 212. The lower folder part 320 comprises a rear case 340 and a front case 350. The rear case 340 comprises the antenna 10 mounted thereon and a battery 342. The front case 350 comprises a main printed circuit board 352, a keypad 354, and a camera module 356.

Figure 14A:
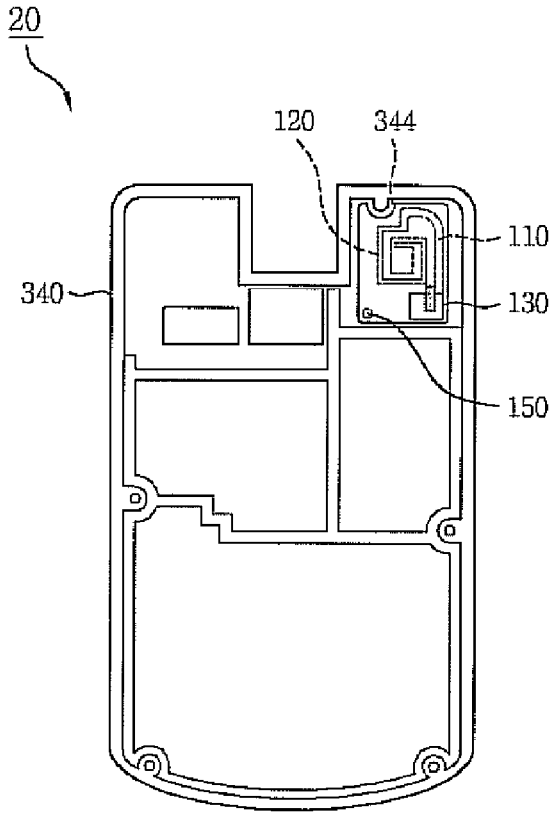
FIGS. 14A and 14B are plane views illustrating a rear case and a front case respectively of a lower folder part of a folder-type mobile communication terminal.
Figure 14B:
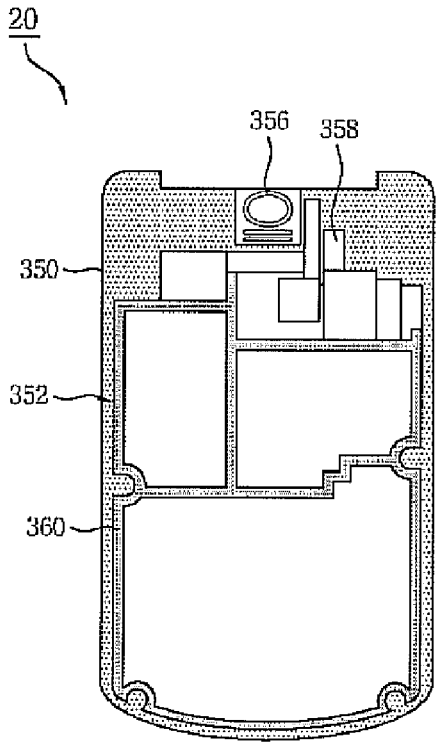

The rear case 340 and the front case 350 will be described in detail with reference to FIGS. 14A and 14B. FIGS. 14A and 14B are plane views illustrating the rear case and the front case of the lower folder part in a folder-type mobile communication terminal, respectively.

Referring to FIGS. 14A and 14B, one side of the rear case 340 has a space 344 for housing the antenna 10 shown in FIGS. 1 and 2. A fixing mold (not shown), which is a hanger for fixing the antenna 10, may be formed in the space 344 before the substrate 100 of the antenna 10 is combined with the rear case 340 using a locator pin 150.

When the antenna 10 is mounted in the space 344, the first pattern 110 of the antenna 10 is positioned toward the outer side of the rear case 340 and the second pattern 120 is positioned toward the inner side of the rear case 340.

The antenna 10 is mounted on the terminal wherein the front side of the substrate 100 where the first and second patterns 110 and 120 are formed in the inner side of the space 344, and the rear part of the substrate 100 in the outer side of the space 344. Thus, the bushing 130 for feeding the antenna 10 comes in the outer side of the space 344.

The combiner 350 is formed on one side of the substrate 100 of the antenna 10 to combine the substrate 100 with the rear case 340. The combiner 350 stably combines the antenna 10 with the rear case 340 using a screw bolt.

The stable connection between the antenna 10 and the rear case 340 in the space 344 can make the body (see 320 of FIG. 13) of the terminal 20 slim without the antenna protruding from the body.

The antenna 10 and the space 344 are disposed in a position that is not touchable by a user. Also, the first pattern 110 is formed to be inclined to an external side of the mobile communication terminal 20. One side of the second pattern 120 is formed at a position apart from one side of the substrate 100 by a predetermined distance hereby reducing the deterioration of the radiation characteristics by the proximity of a user and also reducing interference from other components.

The camera module 356 is mounted on the front case 350 and the front case 350 is combined with the rear case 340. The camera module 356 is disposed at a position not overlapping the antenna. For example, the camera module 356 is positioned at the centerline of the hinge 330 of FIG. 13, and the antenna 10 is disposed on the right or left side of the camera module 356. Interference can be further reduced by disposing the camera module 356 on the front case 350 and the antenna 10 in the rear case 340.

In addition, as illustrated in FIG. 14B, it is possible to further prevent radiation characteristics of the antenna 10 from being affected by peripheral components and deteriorated by forming a flexible printed circuit board 358 electrically connecting the main printed circuit board 352 with the camera module 356 at a position in opposite to the antenna 10.

The antenna 10 does not overlap the upper part of the main printed circuit board providing a ground 360. "Not overlap" means that the ground 360 is formed within a predetermined distance from the upper part of the main printed circuit board 352, and it does not exclude a case where the upper part of the main printed circuit board 352 without the ground 360 is overlapped to what extent to be fixed with the antenna 10.

Also, one side of the ground 360 forms a straight and parallel line with the first pattern 110 of the antenna 10. The ground 360 is formed to include the perimeter of the main printed circuit board 352.

The antenna 10 mounted on the terminal 20 may be used as a quadband internal antenna. Quadband supports all GSM frequencies, i.e., 850 MHz, 900 MHz, 1800 MHz, and 1900 MHz, and a quadband antenna can be used in all countries using different frequency bands of the Global System for Mobile (GSM) such as Europe, the United States, and Asian countries.

A primary resonance from 850 MHz to 900 MHz is generated along entire length of the first and second patterns 110 and 120 of the antenna 10, and a secondary resonance from 1800 MHz to 1900 MHz is generated in the first pattern 110. Therefore, the antenna 10 can easily support the quadband.

Performances of the terminal 20 at low frequency bands and high frequency bands of the antenna 10 having patterns on one side are described below.

Figure 15A:
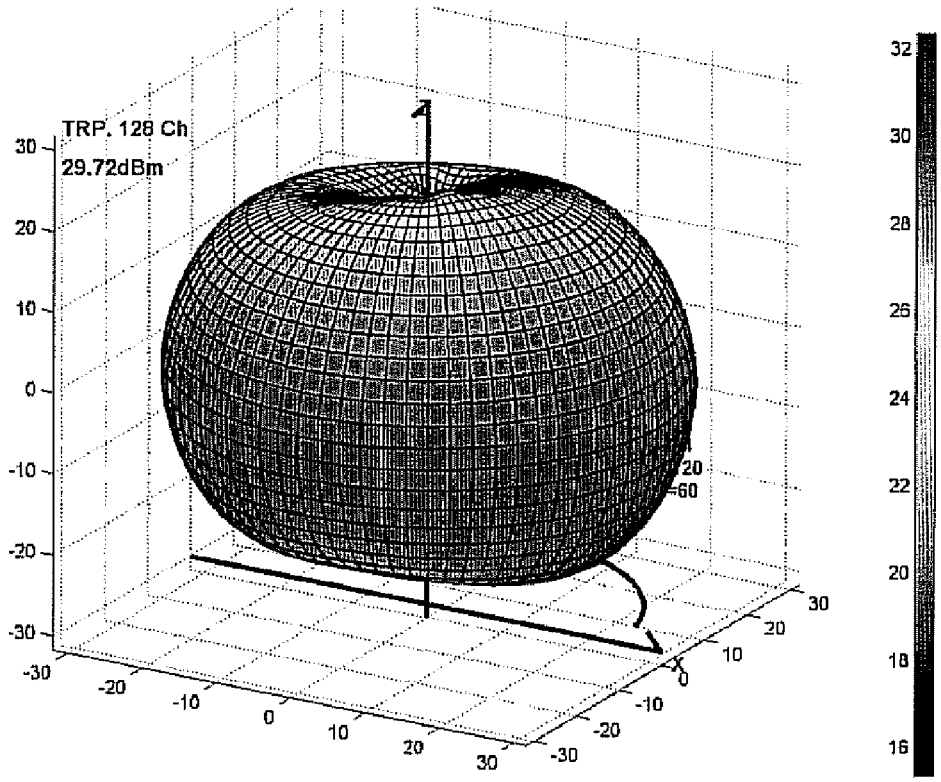
FIGS. 15A and 15B are Total Radiated Power (TRP) three-dimensional graphs showing performance of a multi-band mobile communication terminal at a low frequency band and a high frequency band accordance with the present invention.
Figure 15B:
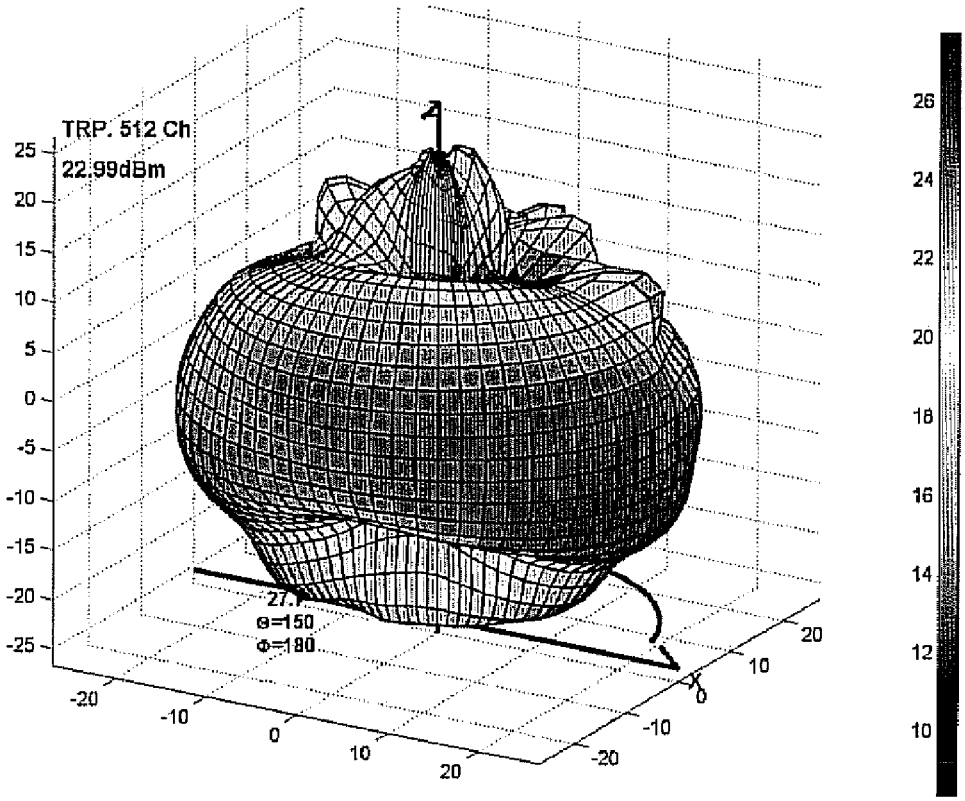

FIGS. 15A and 15B are three-dimensional total radiated power (TRP) graphs showing performance of a multi-band mobile communication terminal at a low frequency band and a high frequency band, respectively. The power value is about 29.72 dBm at the low frequency band ranging from 850 MHz to 900 MHz, and 22.99 dBm at the high frequency band ranging from 1700 MHz to 1900 MHz. The result shows that performance of the internal antenna is not inferior to that of an external antenna.

Figure 16:
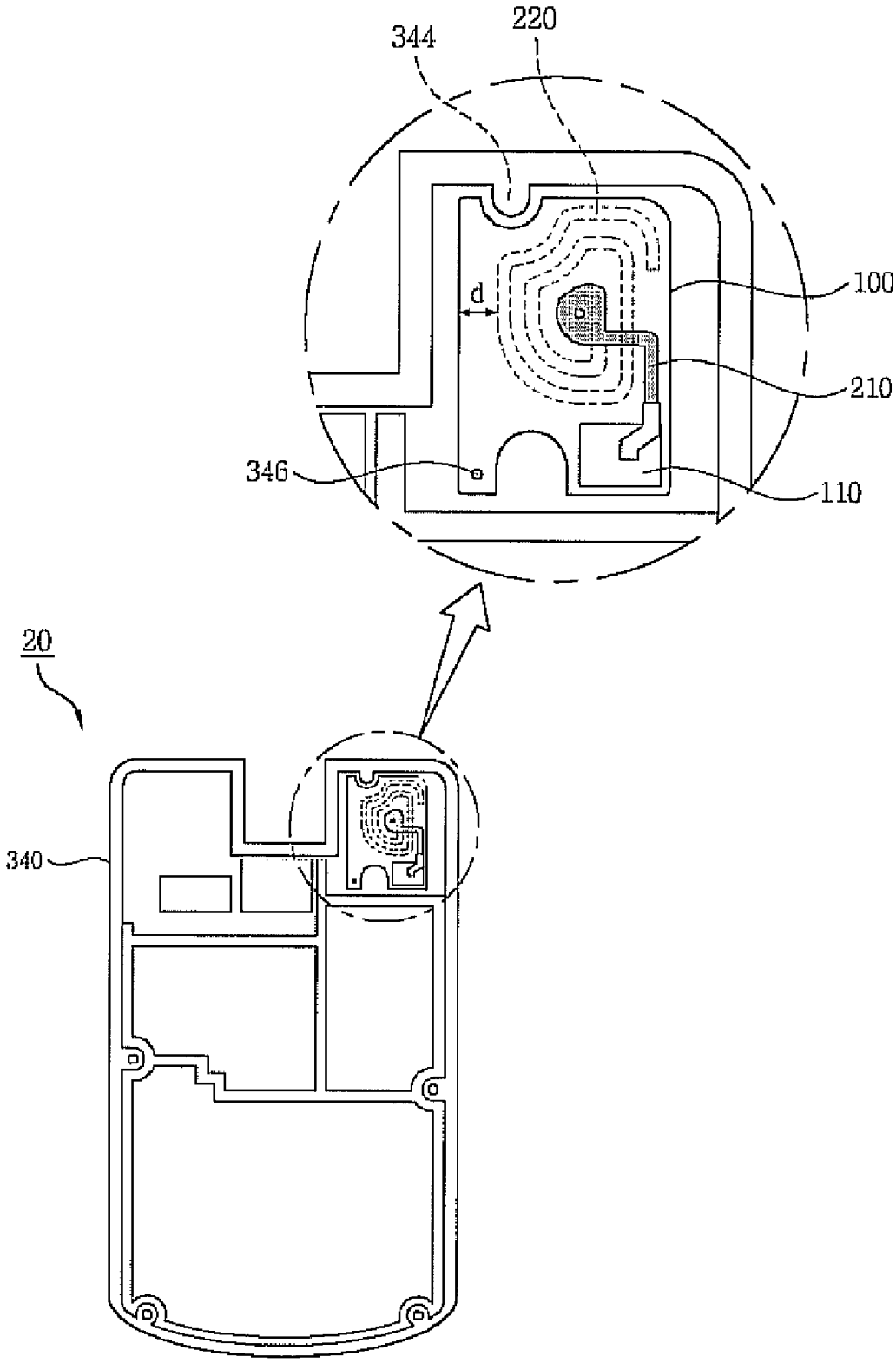
FIG. 16 is an exemplary plane view showing an antenna having patterns on both sides mounted in a mobile communication terminal.

The antenna 10 with patterns formed on different sides can be mounted on the mobile communication terminal in a similar method as described above. FIG. 16 is an exemplary plane view showing an antenna having patterns on both sides mounted in a terminal.

Referring to FIG. 16, the antenna 10 is mounted in the space 344. The substrate 100 is mounted in the space 344 with the rear side of the substrate 100 where the first pattern 210 directed outward. The front side of the substrate where the second pattern 220 is formed is directed to the inside of the space 344.

As a result, the bushing 130 which is formed on the rear side of the substrate 100 and feeds the antenna 10 is directed to the outside of the space 344 to be connected to a feeding circuit formed on the main printed circuit board 352.

The deterioration in the resonance characteristic occurring when the upper folder part 310 of the mobile communication terminal 20 is closed can be improved by positioning the initial end 210*a* of the first pattern 210 and the terminal end 220*a* of the second pattern 220, which are points of the strongest electromagnetic field in the antenna patterns, at the edges of the substrate 100 and positioning the portion of the antenna where the electromagnetic field is relatively weak on the inner side of the substrate 100.

The space 344 and the antenna 10 are disposed in a position not touchable by a user. Also, the first pattern 210 and the second pattern 220 are disposed on the outer part of the mobile communication terminal 20, and one side of the second pattern 220 is apart from the side of the substrate 100 by a predetermined width (d). Therefore, the radiation characteristic can be prevented from being reduced by the proximity of a user, and the interference caused between the constituent elements of a terminal 20 can be reduced.

With the patterns on different sides, the characteristics of the antenna 10 can be protected from deterioration caused when the folder-type mobile communication terminal 20 is closed. Therefore, the signal reception performance of the antenna is improved in the terminal 20.

Figure 17:
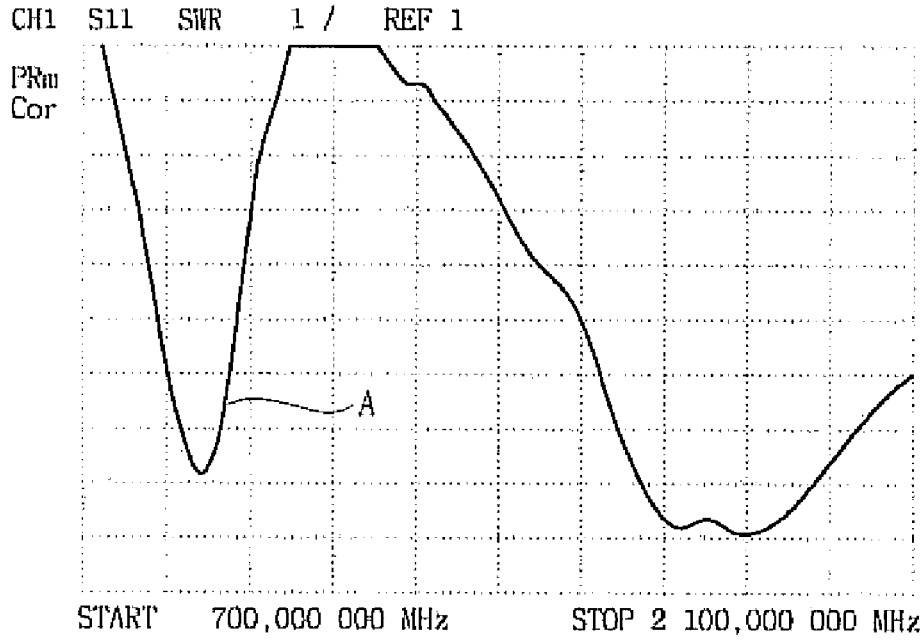
FIGS. 17(*a*) and (*b*) is shows the performance variation according to whether a conventional folder-type mobile communication terminal is open or closed.
Figure 17:
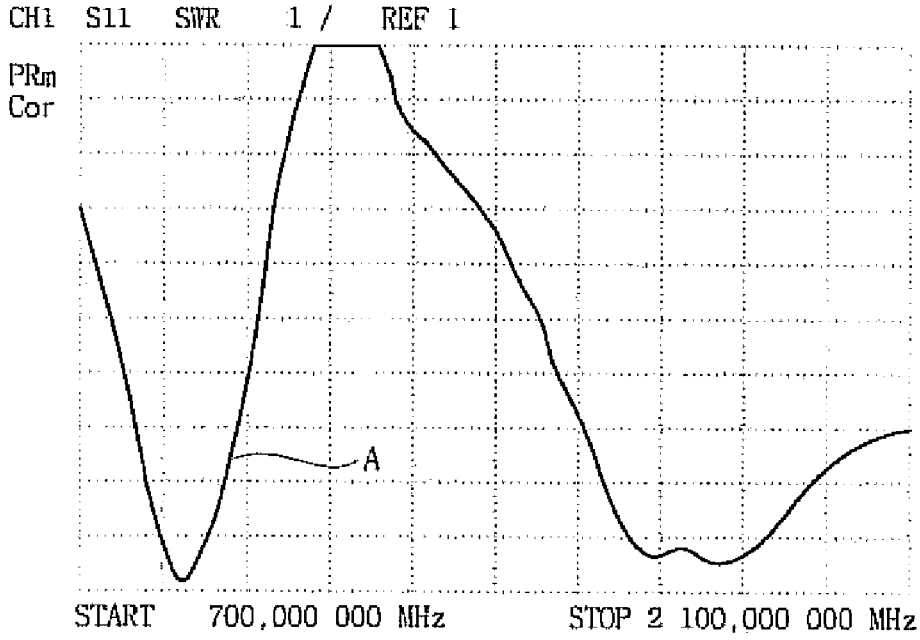
Figure 18:
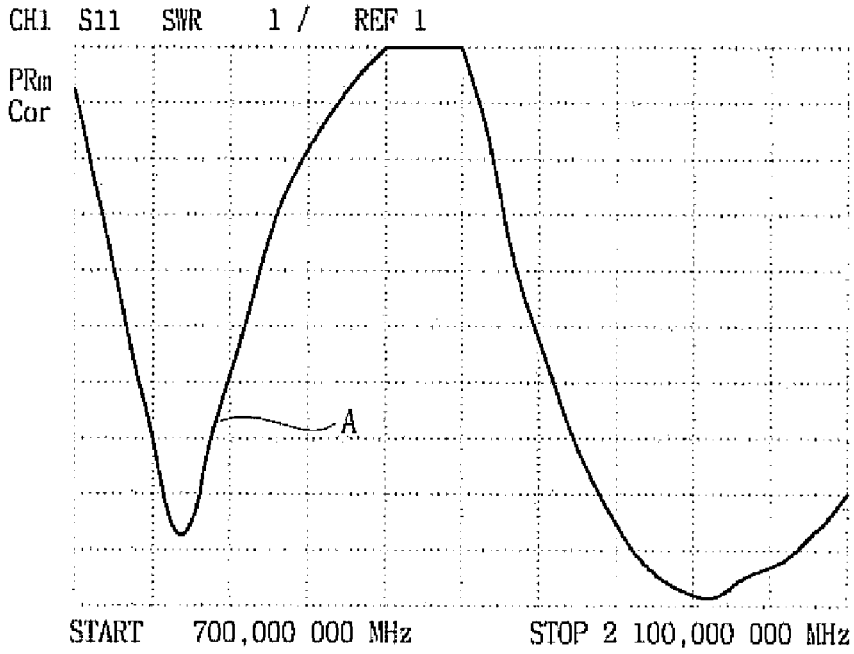
FIGS. 18(*a*) and (*b*) shows performance variation according to whether a folder-type mobile communication terminal is open or closed.
Figure 18:
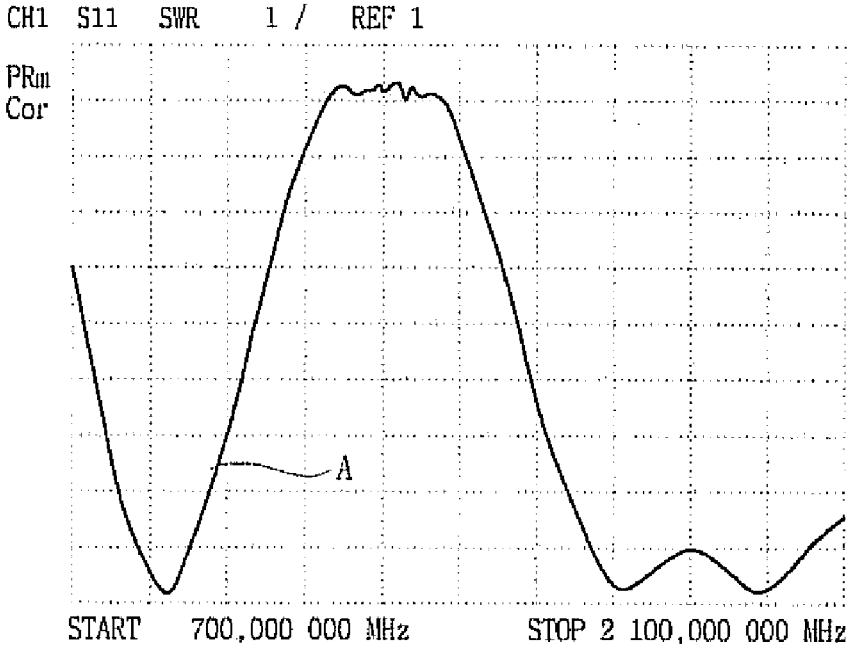

FIG. 17 is a graph showing variance in performance according to whether a conventional folder-type mobile communication terminal is open or closed, and FIG. 18 is a graph showing variance in performance according to whether a folder-type mobile communication terminal is open or closed.

Referring to FIGS. 17(*b*) and 18(*b*), there is no remarkable change in the antenna performance when the upper folder part 310 of the terminal 20 is open. However, according to a voltage standing wave ratio (VSWR) of FIG. 18(*a*), reflective wave generated when the upper folder part 310 is closed is smaller than that of the conventional mobile communication terminal shown in FIG. 17(*a*). The VSWR is an index showing a reflection amount of energy received when the folder-type mobile communication terminal 20 is open or closed.

In summary, the signal reception performance of the antenna 10 can be improved by reducing the reflective wave generated when the upper folder part 310 is closed in the folder-type mobile communication terminal 20 with the antenna 10 suggested in the embodiments of the present invention.

The TRP and TIS of the terminal 20 with antenna 10 are measured and presented in FIG. 19. FIG. 19 is a table showing TRP and TIS measurement results of the mobile communication terminal including the antenna in accordance with the present invention.

Referring to FIG. 19, whereas the TIS generated when the upper folder part 310 of a GSM850-base mobile communication terminal is 99.8 or 100.5, the TIS of the mobile communication terminal 20 including the antenna 10 manufactured according to the embodiment of the present invention is improved to 100.90 or 102.00.

The above-described embodiment only describes a folder-type mobile communication terminal 20 comprising the upper folder part 310 and the lower folder part 320, but the present invention is not so limited. Antenna 10 may be mounted in all types of mobile communication terminals such as a slide-type and a bar-type.

Although the antenna 10 described above is mounted in the rear case 340 of the lower folder part 320, the present invention should not be limited to such an embodiment. Antenna 10 may be positioned in any way that does not degrade the antenna performance in consideration of the type of the mobile communication terminal, such as a slide-type and a bar-type.

In addition, although the terminal 20 described above includes the ground 360 formed around the perimeter of the main printed circuit board 352, the present invention is not so limited. When the mobile communication terminal 20 of the present invention includes a metal keypad, the metal keypad may be used as the ground 360.

The foregoing examples and aspects of the invention are merely exemplary and are not to be construed as limiting the present invention. The present teaching can be readily applied to other types of apparatuses. Also, the description of the examples an aspects of the present invention are intended to be illustrative, and not to limit the scope of the claims, and many alternatives, modifications, and variations will be apparent to those skilled in the art.

What is claimed is:

1. A mobile communication terminal for use in a multi-frequency band wireless communication, comprising:

a case configured to house a circuit board; and an antenna module disposed inside the case and configured to transmit and receive first and second frequency bands, the antenna comprising:

a substrate;

a first antenna pattern formed on the substrate for the first frequency band and having a first length and a first width;

a second antenna pattern formed on the substrate for the second frequency band and having a second length and a second width that is different from the first width, the second antenna pattern connected to the first antenna pattern; and a bushing formed on the opposite side of the substrate having the first and second antenna patterns and electronically connected thereto through a via hole, wherein the first antenna pattern is selected to allow both the first and second antenna patterns to be used for the second frequency band.

2. The terminal of claim 1, wherein the first width is greater than the second width.

3. The terminal of claim 1, wherein an end of the second antenna pattern comprises a collection surface having a width larger than the second width.

4. The terminal of claim 3, wherein the collection surface has a polygonal shape.

5. The terminal of claim 1, wherein the first antenna pattern with the first width and length are determined to have a half wavelength of the first frequency band that makes a secondary resonance.

6. The terminal of claim 1, wherein the second antenna pattern is connected to the first antenna pattern at an angle of about 90 degrees.

7. The terminal of claim 1, wherein the second antenna pattern is connected to the first antenna pattern at an obtuse angle.

8. The terminal of claim 1, wherein the bushing is formed using surface mounted technology.

9. The terminal of claim 1 wherein the second antenna pattern comprises a spiral structure.

10. The terminal of claim 1 wherein the second antenna pattern comprises a meander structure.

11. The terminal of claim 1, wherein the first and second antenna patterns have a primary resonance from about 850 MHz to 900 MHz.

12. The terminal of claim 1, wherein the first antenna pattern has a secondary resonance from about 1800 MHz to 1900 MHz.

13. The terminal of claim 1, wherein the first antenna pattern and the second antenna pattern are formed on opposite side of the substrate and connected through a via hole.

14. The terminal of claim 13, wherein the second antenna pattern comprises a spiral structure.

15. The terminal of claim 13, wherein the second antenna pattern comprises a meander structure.

16. The terminal of claim 13, wherein a contact surface defining the via hole has a larger width than each of the first and second antenna patterns.

17. A multi-frequency band antenna for use in a mobile communication terminal, the antenna comprising:

a substrate;

a first antenna pattern formed on the substrate and configured to communicate in a first frequency band and having a first length and a first width;

a second antenna pattern formed on the substrate and configured to communicate in a second frequency band and having a second length and a second width that is different from the first width, wherein the second antenna pattern is connected to the first antenna pattern; and a bushing formed on the opposite side of the substrate having the first and second antenna patterns and electronically connected thereto through a via hole, wherein the first antenna pattern is selected to allow both the first and second antenna patterns to be used for the second frequency band.

18. The antenna of claim 17, wherein the first width is greater than the second width.

19. The antenna of claim 17, wherein an end of the second antenna pattern comprises a collection surface having a width larger than the second width.

20. The antenna of claim 19, wherein the collection surface has a polygonal shape.

21. The antenna of claim 17, wherein the first antenna pattern with the first width and length are determined to have a half wavelength of the first frequency band that makes a secondary resonance.

22. The antenna of claim 17, wherein the second antenna pattern is connected to the first antenna pattern at an angle of about 90 degrees.

23. The antenna of claim 17, wherein the second antenna pattern is connected to the first antenna pattern at an obtuse angle.

24. The antenna of claim 17, wherein the bushing is formed using surface mounted technology.

25. The antenna of claim 17, wherein the second antenna pattern comprises a spiral structure.

26. The antenna of claim 17, wherein the second antenna pattern comprises a meander structure.

27. The antenna of claim 17, wherein the first and second antenna patterns have a primary resonance from about 850 MHz to 900 MHz.

28. The antenna of claim 17, wherein the first antenna pattern has a secondary resonance from about 1800 MHz to 1900 MHz.

29. The antenna of claim 17, wherein the first antenna pattern and the second antenna pattern are formed on opposite side of the substrate and connected through a via hole.

30. The antenna of claim 29, wherein the second antenna pattern comprises a spiral structure.

31. The antenna of claim 29, wherein the second antenna pattern comprises a meander structure.

32. The antenna of claim 29, wherein a contact surface defining the via hole has a larger width than each of the first and second antenna patterns.

* * * * *